United States Patent [19]

Moore

[11] Patent Number: 4,541,765

[45] Date of Patent: Sep. 17, 1985

[54] TRAILER UNLOADING APPARATUS AND METHOD

[75] Inventor: James W. Moore, Akron, Ohio

[73] Assignee: Wills Trucking, Inc., Richfield, Ohio

[21] Appl. No.: 495,690

[22] Filed: May 18, 1983

[51] Int. Cl.[4] ..... B65G 65/30; B65G 67/24

[52] U.S. Cl. ..... 414/267; 220/461; 222/95; 222/104; 414/304; 414/539; 414/786

[58] Field of Search ..... 414/304, 393, 539, 786, 414/267; 105/423; 296/39 R; 222/94, 105, 181, 185; 298/1 B; 220/461

[56] References Cited

U.S. PATENT DOCUMENTS

| | | | |
|---|---|---|---|
| 172,228 | 1/1876 | White | 414/539 |
| 2,792,262 | 5/1957 | Hawthorn | 414/304 X |
| 2,923,423 | 2/1960 | Maney | 414/393 X |
| 2,931,523 | 4/1960 | Nelligan | 414/393 X |
| 3,139,998 | 7/1964 | Seaman | 414/393 X |
| 3,433,400 | 3/1969 | Hawkins | 222/185 X |
| 3,756,469 | 9/1973 | Clark et al. | 222/105 |
| 4,277,220 | 7/1981 | Wiley | 414/539 |
| 4,449,646 | 5/1984 | Bonerb et al. | 222/105 X |
| 4,453,875 | 6/1984 | Johnson, Sr. | 414/304 |

FOREIGN PATENT DOCUMENTS

| | | | |
|---|---|---|---|
| 2479704 | 10/1981 | France | 414/287 |
| 202854 | 2/1963 | Sweden | 414/608 |

*Primary Examiner*—Robert J. Spar
*Assistant Examiner*—Stuart J. Millman
*Attorney, Agent, or Firm*—Renner, Kenner, Greive & Bobak Co.

[57] ABSTRACT

Apparatus and method for unloading bulk material (M) from a rectangular trailer (10') comprising a collapsible rectangular liner (29) having a collapsible funnel-shaped base (31), said liner being hung extended in said container with said base (31) collapsed and its discharge opening (32) inserted in a bottom discharge opening (33) in the trailer (10'), and a cable and winch (44,47) to lift the liner (29) to extend the base (31) for gravity discharge of the bulk material (M) through said bottom discharge opening (33).

10 Claims, 5 Drawing Figures

TRAILER UNLOADING APPARATUS AND METHOD

TECHNICAL FIELD

The invention relates to unloading means and method for self-unloading comminuted bulk materials from containers such as trailers and the like which require inclined unloading surfaces at a high angle of repose to insure gravity flow, while utilizing full cubical capacity of the trailer.

BACKGROUND ART

Conventional hopper cars and trailers for transporting granular and comminuted materials such as grains, cement, flour and carbon black, are provided with bottom discharge surfaces having angles of repose up to and in excess of 45° in order to ensure complete unloading by gravity. However, such inclined surfaces create substantial waste space in the cars or trailers while raising their center of gravity and increasing the construction cost thereof.

Certain prior unloading systems have attempted to overcome these disadvantages by providing collapsible bags or liners which are inflated by blower systems to lift the residual amount of material and create discharge surfaces at or above the required angle of repose to complete gravity discharge. U.S. Pat. No. 2,931,523 discloses such an unloading system. Obviously, such a system requires the availability and added expense of air pressure at the unloading site.

Another prior unloading system utilizing inflatable bags is disclosed in U.S. Pat. No. 3,139,998. This system requires primary and secondary inflatable bags, the primary bags carrying a higher pressure than the larger secondary bags to lift the material carried by the secondary bags to the required angle of repose for gravity discharge. Such a system is even more expensive than that of U.S. Pat. No. 2,931,523, and both systems require inclined frame members on which to mount the inflatable bags.

DISCLOSURE OF INVENTION

The present invention utilizes collapsible liners to contain comminuted bulk material to be transported by trailers and unloaded, but the liners are of novel and improved construction which do not require inflation in order to provide surfaces at the required angle of repose for complete gravity discharge of the material.

It is an object of the present invention to provide a novel and improved liner construction adapted for gravity unloading a full load of comminuted material from a rectangular container.

Another object is to provide a novel and improved method and apparatus for gravity unloading a rectangular container utilizing the novel and improved liner therein.

A further object is to provide an elongated rectangular container having compartments provided with the novel and improved liners and adapted for individually gravity unloading the compartments.

Another object is to provide novel apparatus for hanging said liner in extended position in said container and for lifting said liner to completely unload the material therein by gravity.

These and other objects are accomplished by the improvements comprising the present invention, a preferred embodiment of which is disclosed herein as exemplifying the best known mode of carrying out the invention. Various modifications and changes in details of construction and operation are comprehended within the scope of the appended claims.

PREFERRED EMBODIMENT OF THE INVENTION

Figure 1:
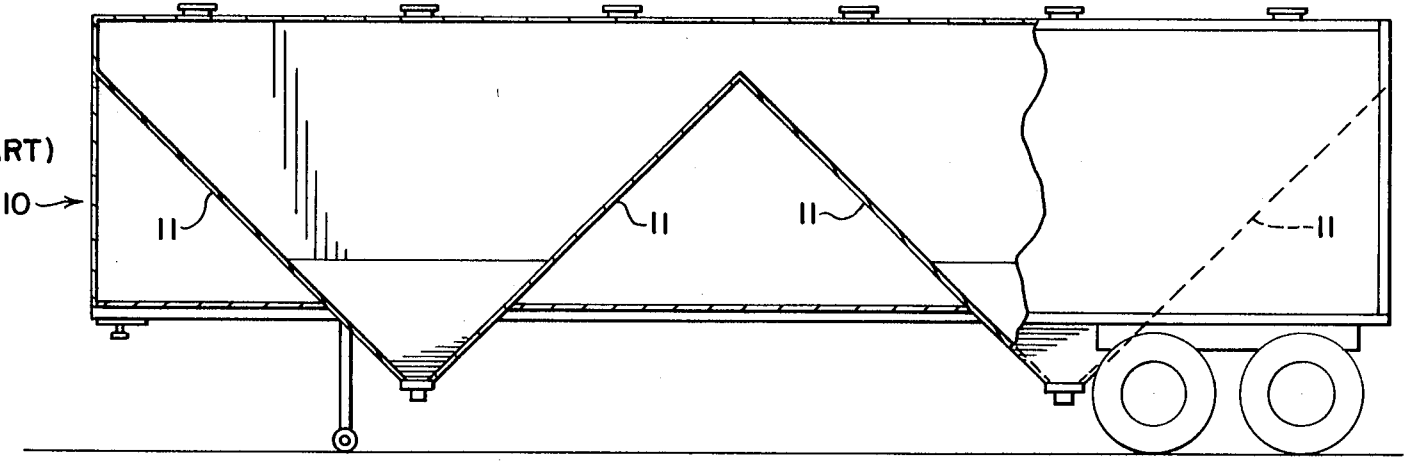
FIG. 1 (PRIOR ART)
FIG. 1 is a longitudinal sectional view of a conventional prior art trailer having a rectangular trailer body with inclined hopper discharge walls.

The cubical content of a hopper type trailer body 10, such as shown in FIG. 1, 8 feet wide by 8 feet high by 40 feet long is about 2560 cubic feet. However, the inclusion of the hopper walls 11 inclined at angles of about 45°, which is the angle of repose required for gravity discharge of a comminuted material such as carbon black, greatly reduces the usable volume carrying the pay load to about 1800 cubic feet. Obviously, the cost of constructing such trailers is substantially increased by the addition of the hoppers.

Figure 2:
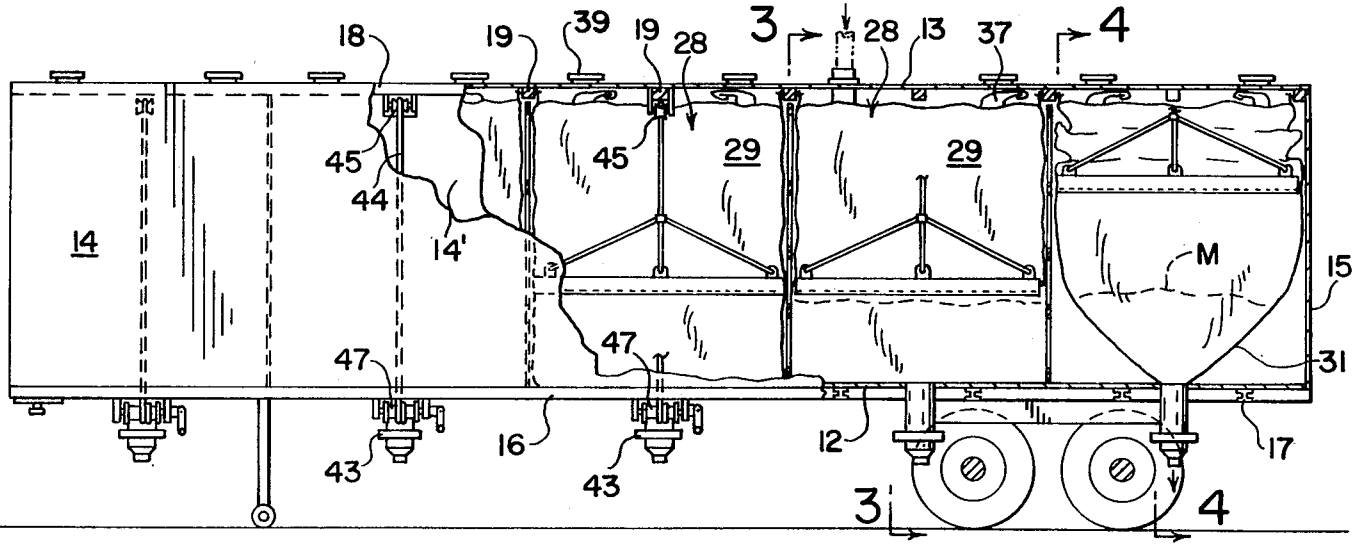
FIG. 2 is a similar view, partly in elevation, of a rectangular trailer embodying the present invention.
Figure 3:
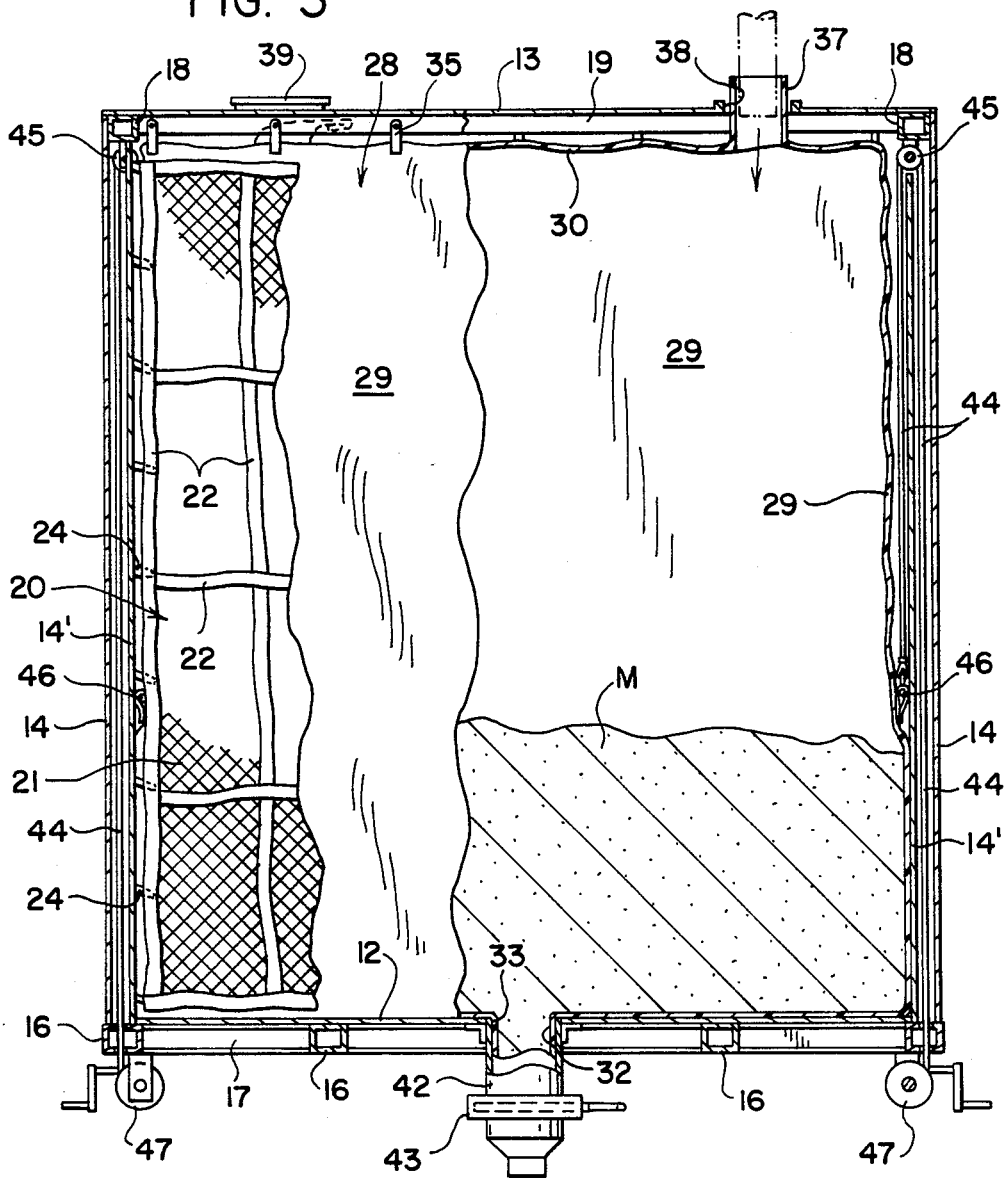
FIG. 3 is a transverse sectional view on line 3—3 of FIG. 2, with parts broken away.
Figure 4:
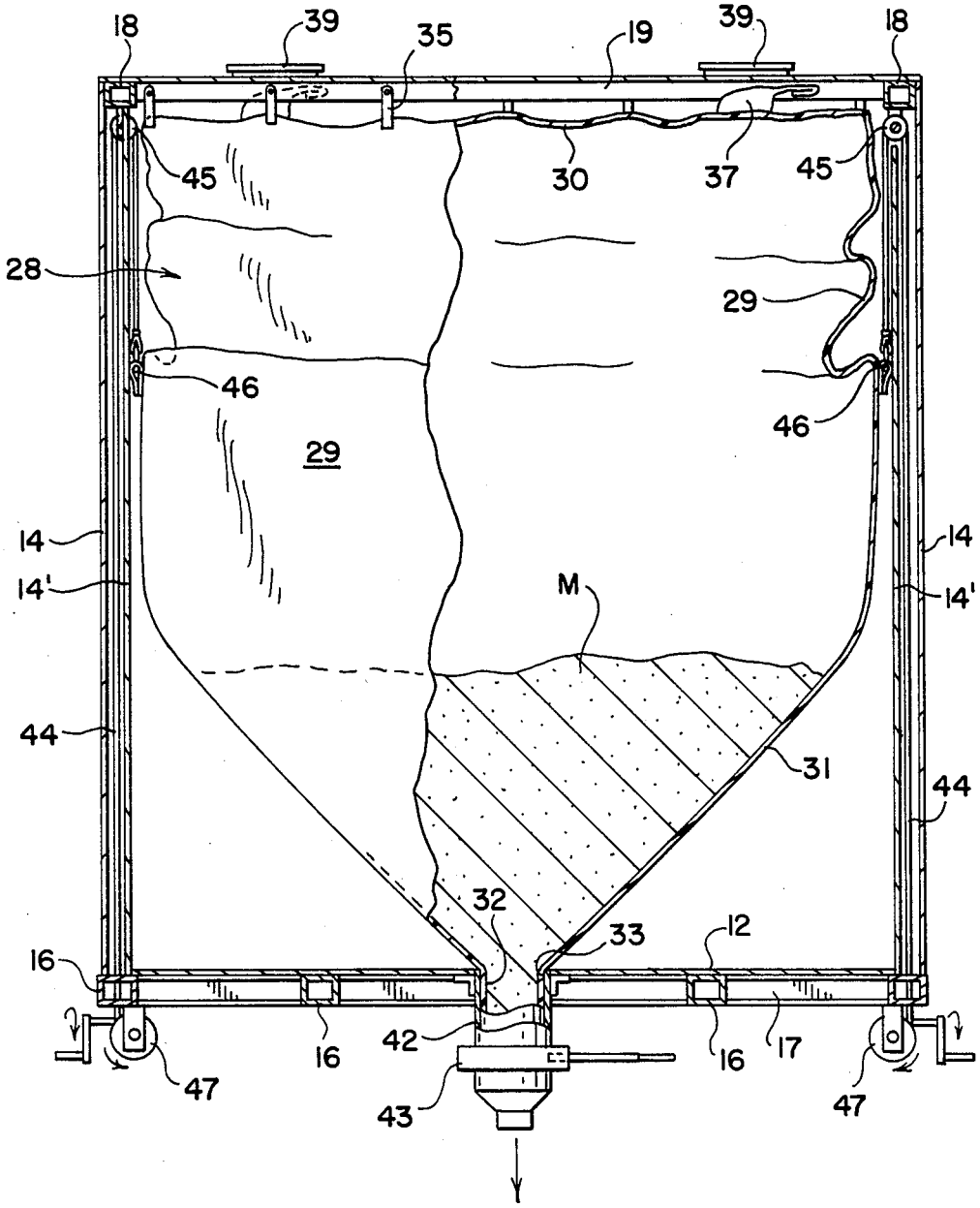
FIG. 4 is a transverse sectional view on line 4—4 of FIG. 2, with parts broken away.

The trailer unloading apparatus of the present invention utilizes a rectangular trailer body without built-in hopper walls. Referring to FIGS. 2–4, the trailer body indicated generally at 10' has a floor 12, roof 13, side walls 14 and end walls 15. The trailer side walls 14 may be double with an inner wall 14' separated by an air space. The floor is supported by longitudinal and transverse beams 16 and 17, respectively, and the roof is carried by longitudinal and transverse beams 18 and 19, respectively, in a usual manner.

Preferably, the trailer body is divided into compartments each substantially 8 feet square, and in the case of a trailer body 40 feet long there would be five compartments as shown in FIG. 1. Obviously, the trailer body could be increased or decreased in length by adding or subtracting one or more compartments. As shown in FIG. 3, the compartments may be formed by partition or divider walls 20, preferably of lightweight fabric or plastic netting 21 with reinforcing webbing strips 22. These dividers may be detachably hung from the roof beams 19, and are detachably connected at intervals along the side edges to the inner surfaces of the trailer side walls 14 by straps 24 or the like. Accordingly, a standard rectangular trailer body is easily divided into compartments for the purpose of the present invention.

Figure 5:
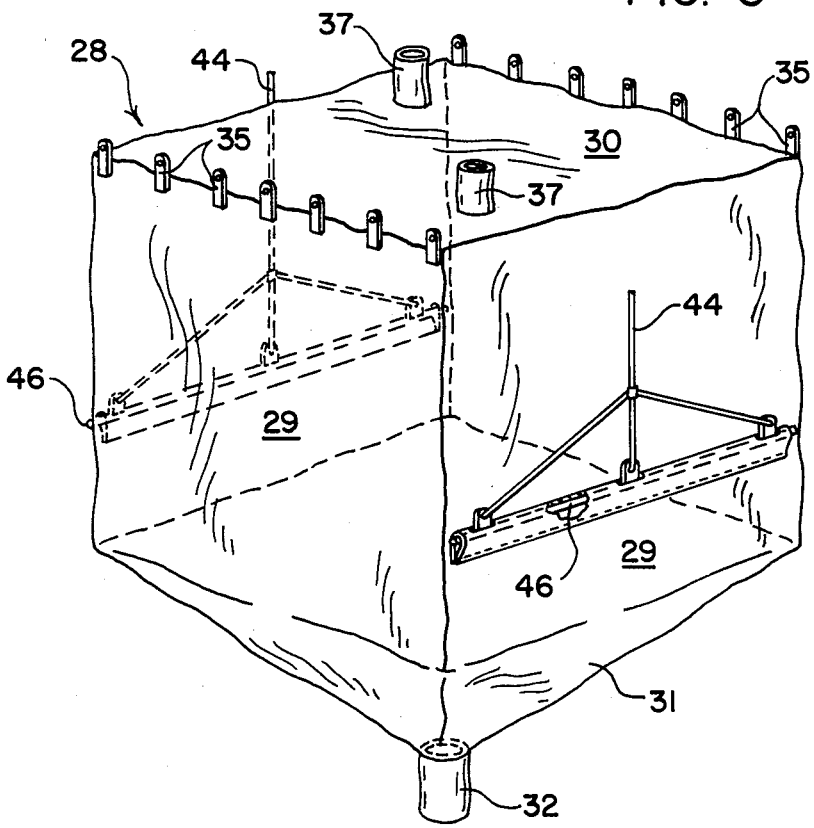
FIG. 5 is a detached perspective view of the novel liner in extended position.

According to the present invention, novel rectangular collapsible liners indicated generally at 28 are designed to fit closely within the compartments formed by the dividers 20. One of these liners is shown in FIG. 5. It is preferably formed of synthetic membrane such as woven polypropylene or nylon treated with polypropylene. However, other synthetic membranes having the required strength and flexibility may be used. Each liner has four sides 29 and preferably a top 30. When extended the four sides are substantially coextensive in height and width to the four sides of the compartments so that the cubical space within the liner is substantially equal to that of the compartment.

Hanging or depending from the bottom of the sides of each liner 28 is a collapsible funnel shaped hopper 31 terminating in a discharge spout 32 designed to fit within a discharge tube 33 in the trailer floor 12 located at the central portion of each compartment. When the hopper portion 31 is extended as seen in FIGS. 4 and 5, the walls are inclined at angles at least 45° to the horizontal, which is approximately the angle of repose for gravity discharge of comminuted material such as carbon black.

In the operation of the improved apparatus, with the trailer roof 18 removed the liners 28 are dropped into the compartments and suspended from the roof beams by straps 35 attached to the upper peripheries of opposite sides of the liners. As shown, the top covers 30 have diagonally spaced filling tubes 37 extending upwardly therefrom. The trailer roof is provided with filling operations 38 for registering with said tubes 37 so that they can be pulled into the openings 38 during the operation of filling the liners with comminuted material M, after which the tubes 37 are tied or folded shut and the openings 38 sealed with closure caps 39.

When the liners 28 are suspended by the straps 35 within the compartments, the side walls 29 extend substantially to floor level and the hopper portions 31 are collapsed on the floor 12 with the discharge spouts 32 entered into the floor discharge openings 33 which are extended below the floor by discharge tubes 42 normally closed by valves 43.

After the liners have been completely filled with comminuted material and the trailer is transported to a discharge station, the valves 43 are opened to allow gravity discharge of the material. After a large proportion of the material has been discharged by gravity the remaining material below the angle of repose is gravity discharged by gradually lifting each liner bodily to extend the hopper portion 31 until its walls equal or slightly exceed the required angle of repose, as shown in FIG. 4.

The means to bodily lift each liner are preferably cables 44 trained over pulleys 45 mounted in the tops of opposite trailer side walls, with one end of each cable secured at spaced locations to spreader bars 46 attached to the sides of the liner about one-third of the distance from the floor level to the roof. The other end of each cable 44 is connected to a winch 47 mounted on the underside of the trailer bottom, as best shown in FIG. 4. As the liner is lifted its flexible walls 29 above the spreader bar automatically fold into the decreasing space below the roof as shown in FIG. 4.

The present invention enables the use of substantially all of the cubical content of a rectangular trailer body for transporting comminuted material and for unloading the material by gravity, except for the minimal space occupied by the membrane divider walls and the membrane liners, the cost of which is substantially less than the extra cost of using hopper type trailers and is more than offset by the increased payload carried by the fully loaded rectangular trailer bodies. Moreover, there is no necessity to have compressed air available at the unloading station.

I claim:

1. Apparatus for selectively compartmentalizing a rectangular container, for transporting comminuted bulk material, having a planar floor provided with discharge openings therein and side and end walls extending upwardly from the floor comprising:

a plurality of collapsible rectangular liners, each said liner having side walls and end walls substantially coextensive in height with the container side and end walls, and having a collapsible funnel-shaped base adapted to extend below said side and end walls of said liner, said base being further adapted to communicate with a discharge opening in the planar floor;

means to selectively position said liners within the container with said side and end walls of each said liner substantially extended and said base collapsed upon the planar floor, and communicating with a corresponding discharge opening, to permit each said liner to receive material; and, means to selectively bodily lift at least one said liner and extend said funnel-shaped base to facilitate gravity discharge of material through a corresponding discharge opening, said means being attached to opposite sides of said liner along the junction between its side walls and the funnel-shaped base.

2. An apparatus, as described in claim 1, wherein the walls of the funnel-shaped base when extended have an angle of repose adapted for complete gravity discharge of the comminuted material.

3. An apparatus, as described in claim 2, wherein said angle of repose is substantially 45°.

4. An apparatus, as described in claim 1, further comprising partition walls removably secured to the side walls of the container, said partition walls positioned substantially coextensive with said end walls of said liners.

5. An apparatus, as described in claim 4, wherein the partition walls are flexible membrane hung from the top of the container and removably secured to the side walls.

6. An apparatus, as described in claim 1, wherein the means to bodily raise the liner comprise rope and pulley means mounted on the container side walls and operable from below the floor of said container.

7. An apparatus, as described in claim 1, wherein said liner is constructed of a reinforced membrane of synthetic resin.

8. An apparatus, as described in claim 7, wherein the walls of said funnel-shaped base have an angle of repose adapted for complete gravity discharge of said bulk material.

9. A method for unloading comminuted bulk material from a selectively compartmentalized container having a planar floor with normally closed bottom discharge openings and upstanding walls, comprising the steps of:

providing a plurality of collapsible rectangular membrane liners having walls substantially coextensive in height with the container walls, each said liner further having a collapsible funnel-shaped base depending from said liner walls;

selectively positioning said liner in the container with said walls of said liner extended and said base in register with the planar floor and collapsed thereupon, and communicating with the discharge opening;

loading material into the respective said liners; and, unloading material by selectively opening the discharge openings and bodily raising said liners from opposite sides thereof along the junction between said side walls and said funnel-shaped base of the respective liners thereby extending said funnel-shaped base for gravity discharge.

10. A method, as described in claim 9, further comprising the step of providing partition walls removably secured to the wall of the container to form compartments, each compartment having a collapsible rectangular membrane liner positioned therein, said partition walls disposed coextensively with said walls of said liner.

* * * * *